United States Patent [19]

Bernard et al.

[11] 4,398,747

[45] Aug. 16, 1983

[54] TOE FITTING OF SAFETY SKI BINDING

[75] Inventors: Jean Bernard; Jean J. A. Beyl; Philippe Buzon, all of Nevers; Daniel le Faou, Nievre, all of France

[73] Assignee: Ste Look, Nievre, France

[21] Appl. No.: 215,565

[22] Filed: Dec. 11, 1980

[30] Foreign Application Priority Data

Dec. 21, 1979 [FR] France ..... 79 31409

[51] Int. Cl.[3] ..... A63C 9/085

[52] U.S. Cl. ..... 280/630; 280/634; 280/636

[58] Field of Search ..... 280/630, 629, 616, 636, 280/620, 628, 618, 625, 634

[56] References Cited

U.S. PATENT DOCUMENTS

| | | | |
|---|---|---|---|
| 2,854,242 | 9/1958 | Pratt | 280/628 |
| 2,858,138 | 10/1958 | Sabloniere | 280/616 |
| 3,432,179 | 3/1969 | Marker et al. | 280/630 |
| 3,667,770 | 6/1972 | Lawrence | 280/629 |
| 4,190,264 | 2/1980 | Himmetsberger et al. | 280/618 |
| 4,219,217 | 8/1980 | Gertsch | 280/629 |

*Primary Examiner*—David M. Mitchell

*Attorney, Agent, or Firm*—Jordan B. Bierman; Linda Bierman

[57] ABSTRACT

This toe-fitting for safety ski binding is of the type intended for operating in conjunction with a boot supporting device and includes a boot supporting plate movable across the ski and adapted, during its movement, to cause through a cam mechanism the translation along the ski axis of a slide controlling the release spring in order to reduce the resistance thereof to the ski boot release movement, the release threshold being thus kept to a substantially constant value notwithstanding the presence of dirt, mud or other unevennesses on the bottom surface of the boot sole.

8 Claims, 15 Drawing Figures

TOE FITTING OF SAFETY SKI BINDING

BACKGROUND OF THE INVENTION

1. Field of the Invention

The present invention relates in general to safety ski bindings and has specific reference to an improved toe fitting therefor.

2. The Prior Art

Conventional safety ski bindings consist generally of two devices for releasably retaining the boot on the ski, namely a toe fitting or device engaging the toe end, either the sole or the upper, of the ski boot, and a heel hold-down fitting or device engaging the boot heel.

In case of excessive effort subjecting the skier's leg to torsion stress, the toe fitting moves in a direction substantially across the ski against the resilient force of a pre-adjusted retaining device and releases the boot; in case of excessive vertical effort due to a forward fall of the skier, the heel hold-down fitting moves upwards in a substantially vertical direction, also against the force of pre-adjusted resilient means, and releases the boot.

To prevent substantial frictional contacts from detrimentally interfering with the torsional release by producing undesired efforts adding themselves to the inherent release force of the toe fitting, these known safety ski bindings are provided with antifriction means adapted to support the normalised smooth front portion of the ski boot sole. As a rule, such antifriction means consist of small plates made from a material having a low coefficient of friction such as PTFE, or of bearing members such as rollers or rotary discs. These well-known safety ski bindings are fully satisfactory under normal skiing conditions and provide the desired degree of safety for the skier.

However, when the boot and/or the binding is or are clogged with dirt, the friction developing between the boot and the antifriction device may become excessive and impair the skier's safety. This condition is found notably in so-called summer ski resorts where skiers must walk during relatively long periods on soil not covered with snow and frequently overlaid with mud and gravel, before reaching snow-covered areas where they can put on their skis. An excessive and irregular wear of the bottom surface of the sole may also give rise to the same problem by increasing unduly the coefficient of friction thereof.

When skiing, any defective slip of the ski boot on the ski is further amplified when the skier leans forward. In fact, the skier's weight tends to press the boot with force against the antifriction device so that any mud on, and/or evenness of, the rough-surfaced boot sole tend to penetrate into the ski surface, thus counteracting the lateral release of the ski boot.

It is a primary object of the present invention to solve the problem set forth hereinabove by providing a toe fitting for safety ski bindings wherein the resistance to the boot release action is substantially independent of the boot sole surface condition, from the dual point of view of cleanliness and smoothness.

SUMMARY OF THE INVENTION

For this purpose, the toe fitting according to the instant invention comprises a boot retaining front or toe jaw movable laterally against the pre-adjusted force of resilient means and associated with support means for the front end of the boot sole, said support means comprising at least one movable member adapted to be driven by the transverse movement of the sole. According to this invention, this movable member is operatively connected to said resilient means so that its movement is attended by a gradual reduction in the boot retaining force.

In the various forms of embodiment of the present invention to be described presently the movable member engages said resilient means through the medium of a slide guided for translation in the base of the toe fitting. Preferably, this movable member consists of a plate movable along a path substantially across the ski and notably along a circular path centered to the axis of the pivotal movement of the ski boot in the ski binding. With this arrangement it is possible to avoid any slipping of the ski boot with respect to its supporting device. According to a simplified construction, the movement is transmitted from the movable plate to the slide by means of a cam or through pivoted levers.

In a particularly advantageous form of embodiment of the present invention the slide has a rear extension constituting the bearing member engaged by the toe end of the boot sole so that the slide is shifted and the force retaining the toe fitting decreases when the boot is inclined as a consequence of a forward fall.

The invention will be better understood as the following description proceeds with reference to the attached drawing illustrating diagrammatically three forms of embodiment thereof given by way of example, not of limitation.

THE DRAWINGS

Figure 8:
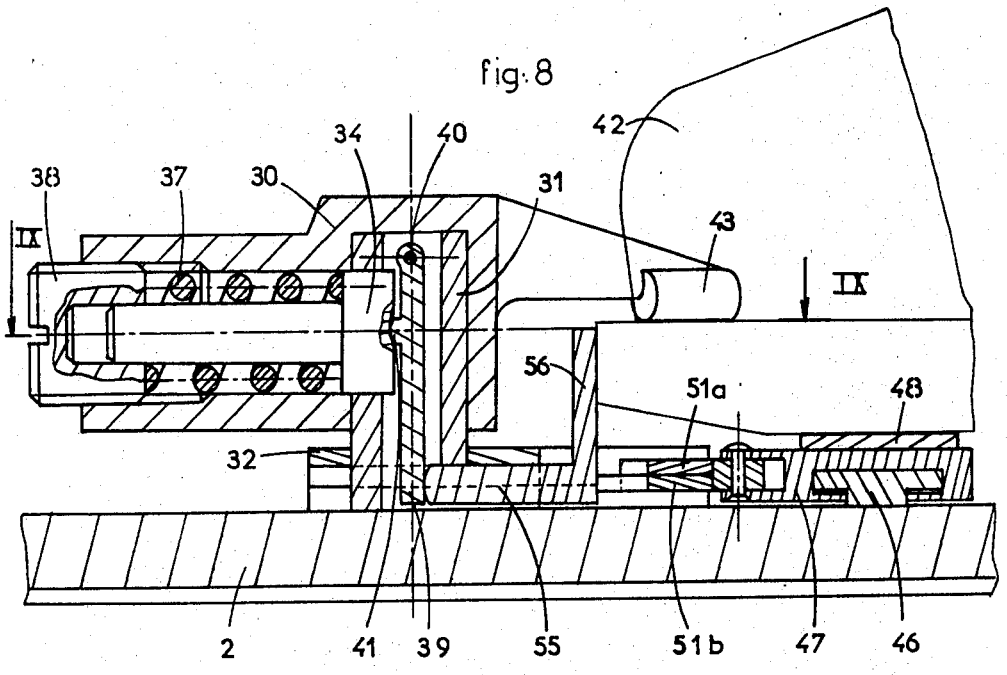
Figure 9:
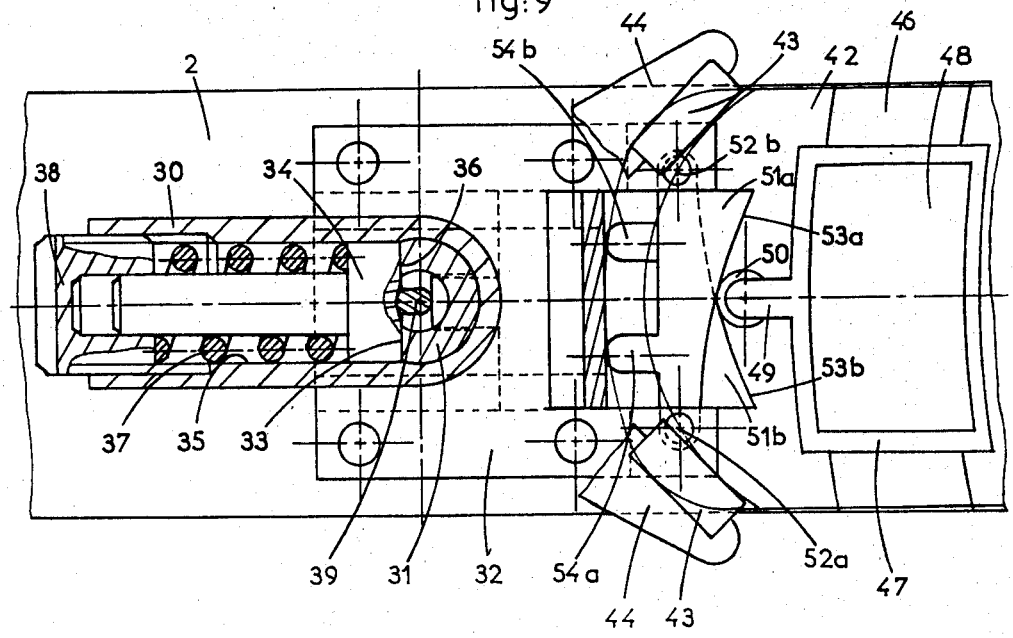
Figure 10:
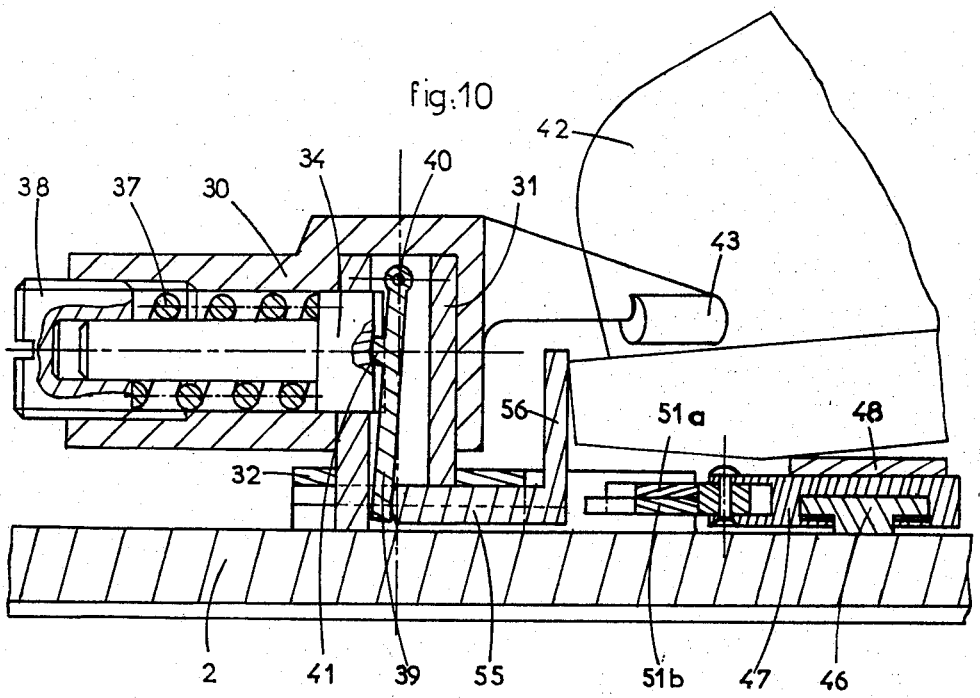
Figure 11:
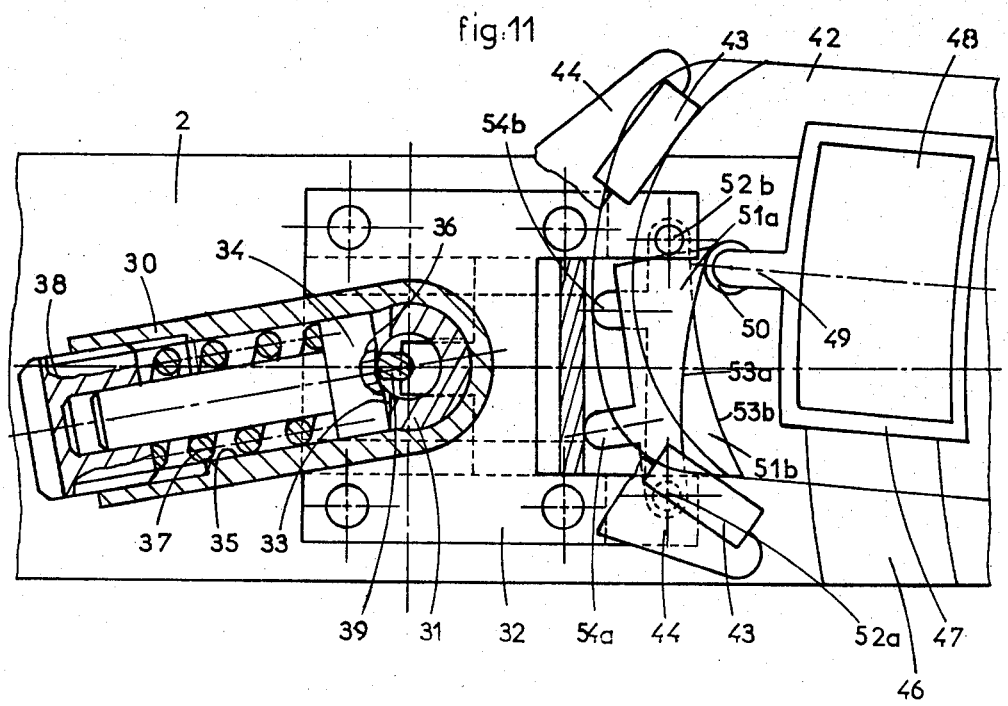
Figure 12:
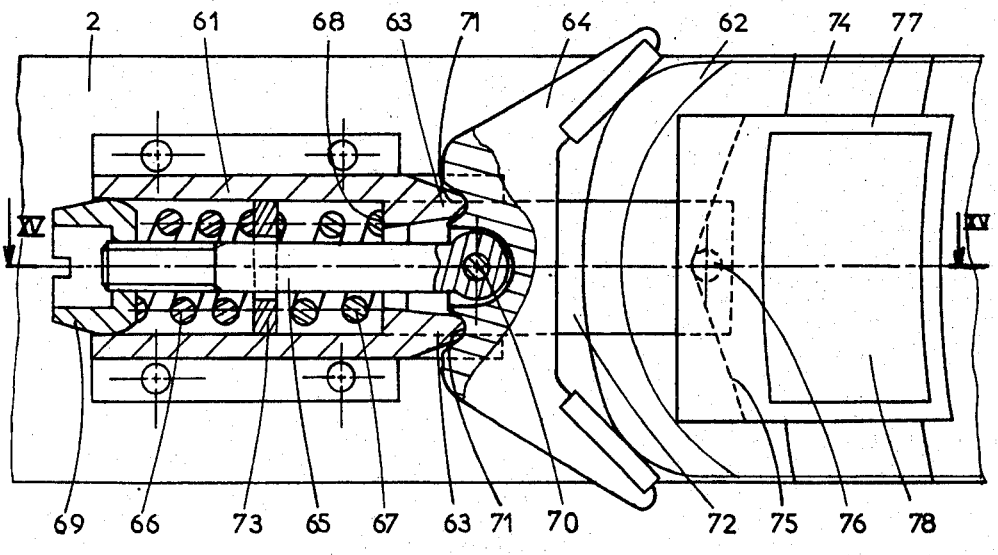
Figure 13:
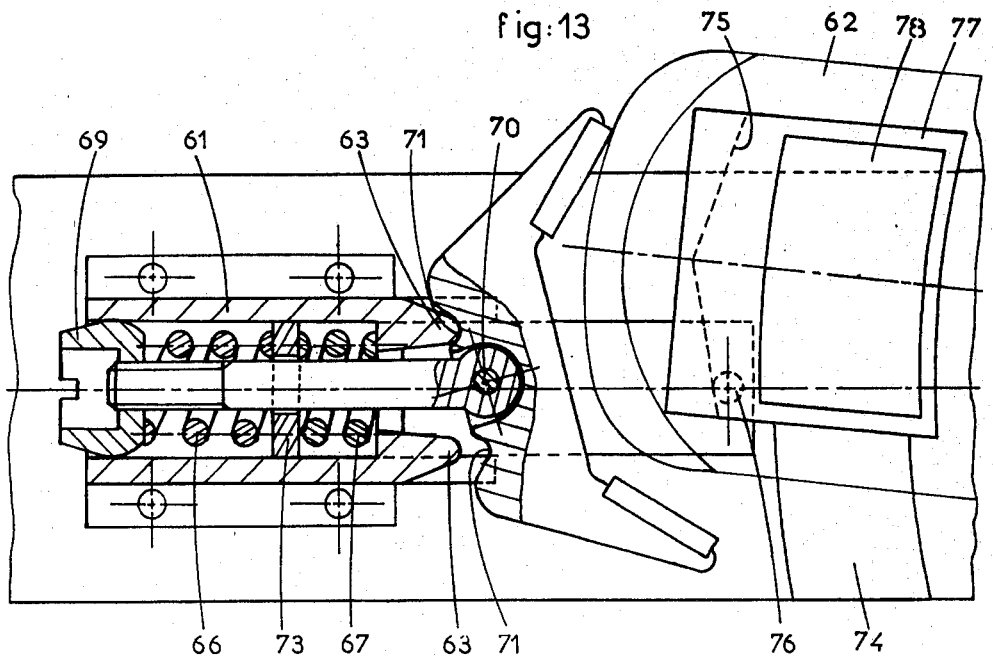
Figure 14:
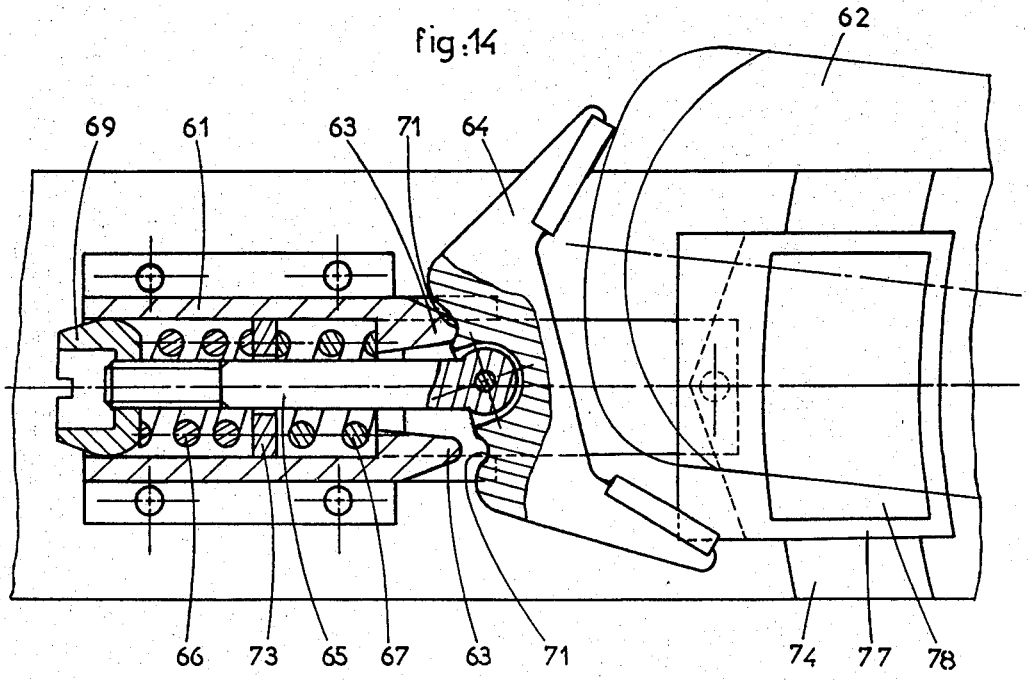
Figure 15:
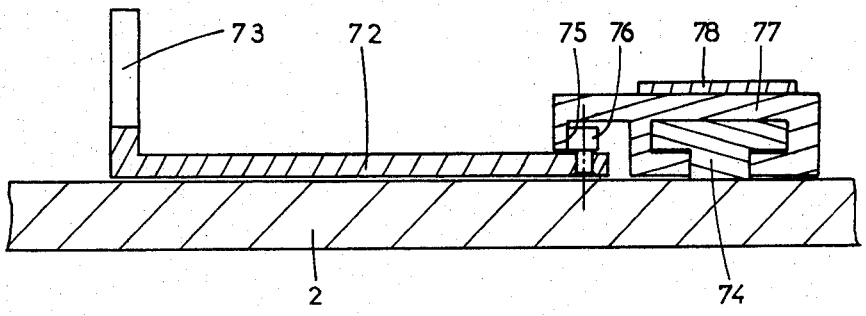

FIGS. 8 to 11 inclusive illustrate a second form of embodiment of the toe fitting of this invention wherein:

FIG. 8 is a side elevational and longitudinal section of the toe fitting;

FIG. 9 is a plan view from above with a section taken along the line IX—IX of FIG. 8;

FIG. 10 is a view similar to FIG. 8 showing the behavior of the device in case of forward fall;

FIG. 11 is a view similar to FIG. 9 showing the mode of operation of the toe fitting in case of relatively high coefficient of frction between the sole and its support;

FIGS. 12 to 15 illustrate a third form of embodiment of a toe fitting according to this invention, wherein:

FIG. 12 is a plan view from above with parts shown in horizontal section;

FIG. 13 is a view similar to FIG. 12 showing the mode of operation of the toe fitting when relatively high coefficients of friction develop between the sole and its support;

FIG. 14 is a view similar to FIG. 12 showing the mode of operation of the toe fitting in case the frictional contacts between the sole and its support are relatively moderate, and FIG. 15 is a fragmentary section taken along the line XV—XV of FIG. 12; showing some of the component elements of the toe fitting in side elevational view.

DESCRIPTION OF THE PREFERRED EMBODIMENTS

Reference will be made firstly to FIGS. 1 to 7 of the drawings, illustrating a first preferred form of embodiment of the toe fitting according to this invention.

The toe fitting comprises essentially a body 1 fastened to the ski 2 by means of screws 3, and a jaw 4 pivoted to said body 1 about a vertical pin 5.

The boot 6 bears with the toe end of its upper against linings 7 sunk in or snap-fitted on the side arms of jaw 4, said linings having good slipping properties. The sole bears with its smooth portion 8 having normalised position and sliding coefficient on a support device designated in general by the reference numeral 9. This device comprises a T-sectioned slideway 10 fastened to the ski top surface by means of screws 11, having an arcuate configuration in plan view (FIGS. 2 and 5) and centered substantially to the pivot axis of the boot in its safety ski binding. The slideway 10 acts as a guide means to a movable plate 12 in which a groove of matching cross-sectional contour is formed. A bearing plate 13 rigid with plate 12 supports the bottom surface of sole 8.

The movable plate 12 comprises an integral front extension 14 having its longitudinal axis coincident with the longitudinal center line of the ski. This extension 14 carries at its front end a roller 15 adapted to rotate freely about a vertical axis and to bear against a V-shaped concave cam 16 forming a relatively wide obtuse angle, which is an integral part of a member 17. This member 17 is secured through any suitable fastening means to the rear end of a slide 18 movable in a slideway 20 secured to the ski 2 by means of screws 21.

The resilient means enclosed in the fitting body 1 comprises a pair of coil compression springs 22 reacting against a plate 23 and constantly urging backwards a piston 24 slidably mounted in said body 1. This piston 24 has a flat head 25 which, in the known fashion, engages a flat face 26 formed on the back of jaw 4 in order constantly to hold resiliently the latter in its normal centered position with respect to the ski center line. A screw 27 is provided for adjusting the strength of springs 22.

At its front end the slide 18 comprises an integral vertical extension 19 which, according to a specific feature characterising the present invention, is interposed between the head of piston 25 and the flat face 26 of jaw 4.

Finally, stop members 29 are provided for engaging the central extension 14 of plate 12 and thus limit the lateral movements thereof and prevent this plate 12 from being loosened with respect to the ski. Stop members 29 are rigid with slide 10; furthermore, elongated apertures formed in the front wall of plate 12 enable the sliding movement of the latter notwithstanding the presence of said stop members 29.

Figure 1:
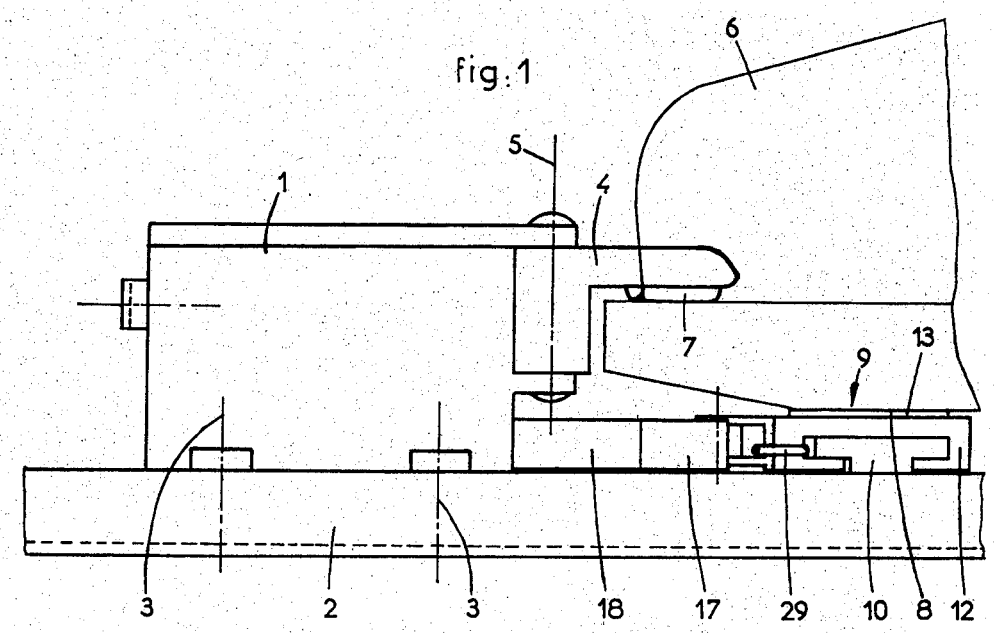
FIG. 1 is a side elevational view of a first embodiment.
Figure 2:
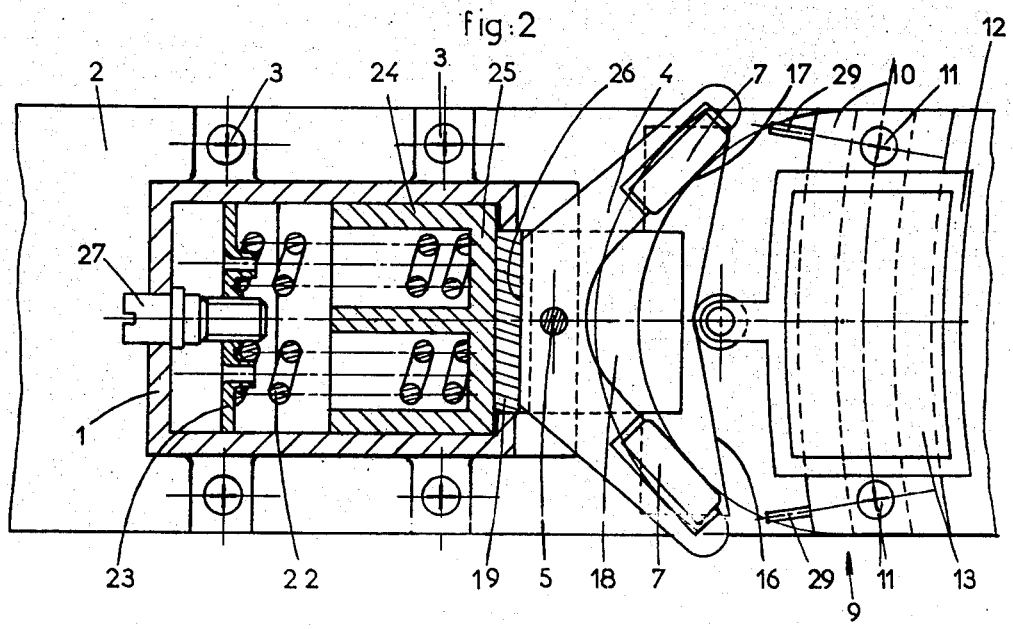
FIG. 2 is a plan view from above with a horizontal section taken along the line II—II of FIG. 3.
Figure 3:
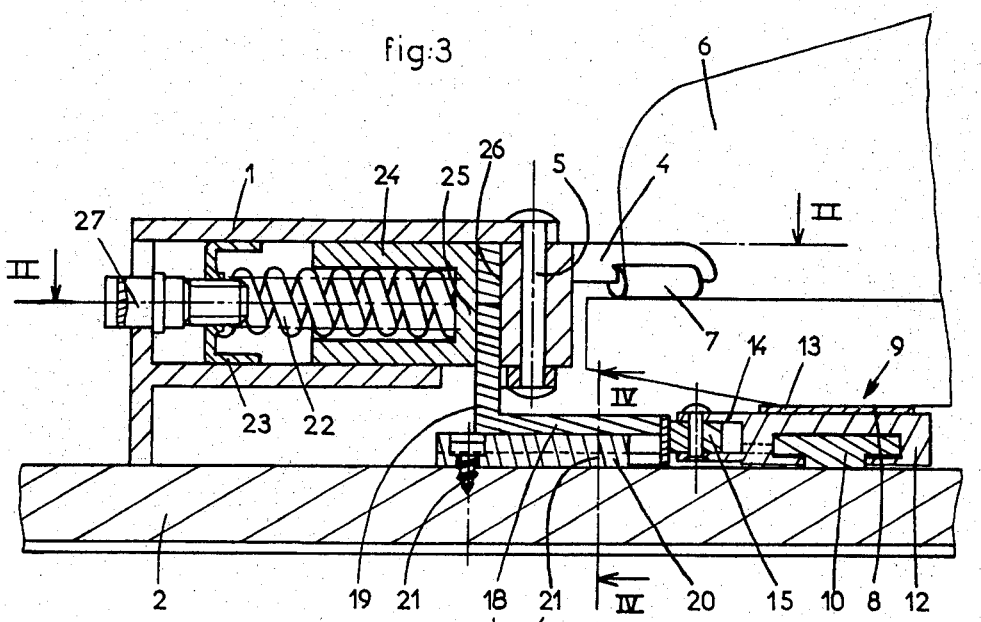
FIG. 3 is a longitudinal section taken along the line III—III of FIG. 5.
Figure 4:
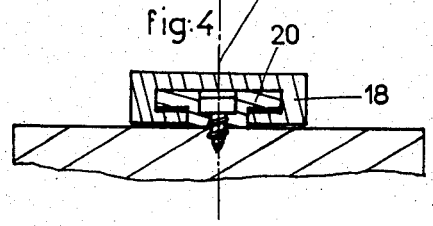
FIG. 4 is a detail view in cross section taken along the line IV—IV of FIG. 3.
Figure 5:
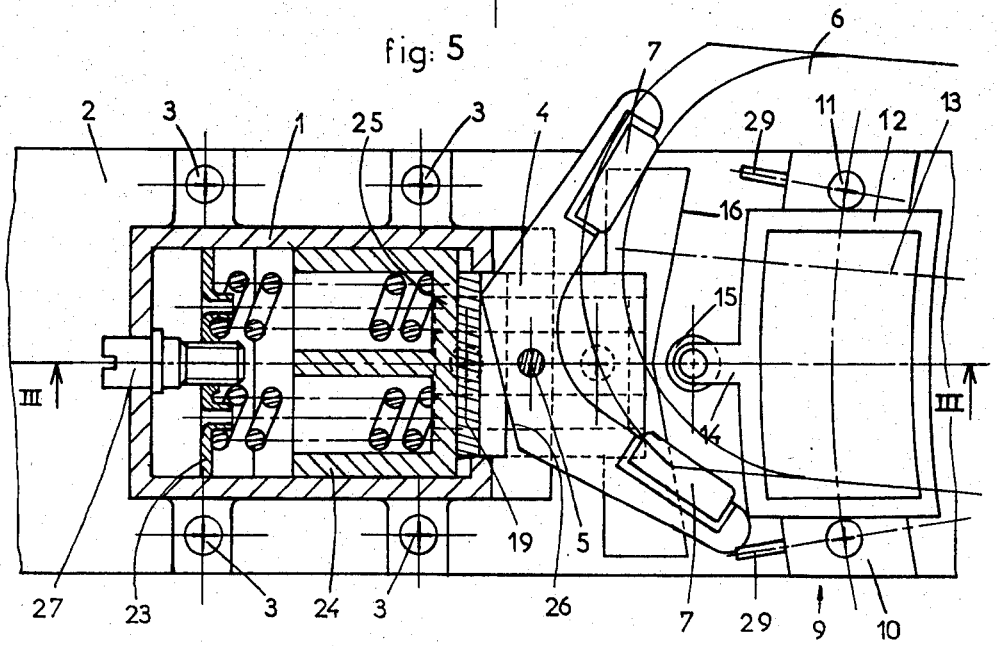
FIG. 5 is a view similar to FIG. 2 showing the mode of operation of the toe fitting in case of moderate frictional contact between the boot sole and its support.

The mode of operation of this toe fitting will now be described in detail. Firstly, it will be assumed that the ski boot is clean and in good shape, and that the skier's weight is properly distributed, the boot bearing flat on the ski (FIG. 3). Under these conditions, the pressure exerted by the sole on bearing plate 13 is relatively moderate and does not appreciably interfere with the boot release in case of excessive torsional movement thereof. In fact, during this release, only the jaw 4 tends to resiliently hold the boot centered on the ski. If the torsion stress exerted on the skier's leg exceeds a predetermined limit in one or the other direction, the jaw 4 will rotate about its pivot pin 5 in the corresponding direction and exert through an end vertex of its back surface 26 a pressure against piston 24 causing the latter to recede and compress the springs 22, possibly until the boot is released completely.

This mode of operation is well known in the art since it is generally adopted for conventional toe fittings or devices of safety ski bindings. The provision of an extension 19 of slide 18 between the jaw 4 and piston 24 causes the slide to move on its guide 20 during the rotation of jaw 4. However, this fact does by no means change the behavior of the fitting in comparison with a conventional toe fitting.

In fact, the force urging or retaining the boot in its normal or skiing position is exerted by the resilient means 22, 24 alone.

Now it will be assumed that the upper or boot 6 is soiled or damaged, and that furthermore the skier is leaning forwards.

Figure 6:
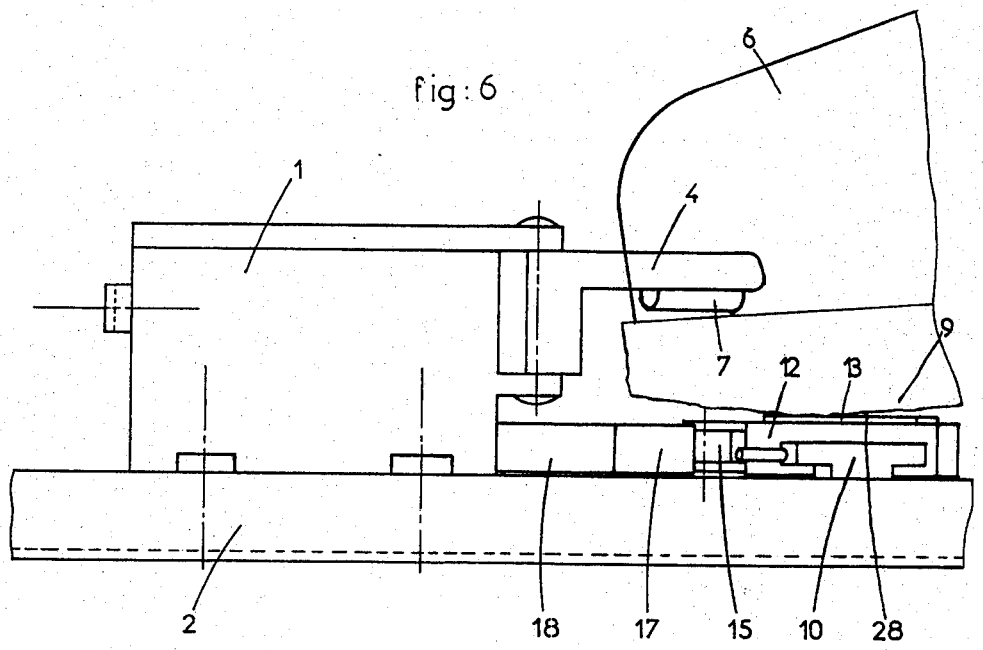
FIG. 6 is a view similar to FIG. 1 showing a clogged boot inclined while engaged in the toe fitting.

This condition is illustrated diagrammatically in FIG. 6 (note the inclined position of the boot, in which the heel—not shown—is lifted off the ski) as well as the presence of unevenness 28 under the boot sole, due to the soiling and/or wearing thereof. Therefore, when the skier's weight bears on the support device 9 and due to the aforesaid unevenness 28 of the bottom surface of the sole, relatively high frictional forces are applied to bearing plate 13.

Under these conditions, if a considerable torsional effort is exerted on the skier's leg, the toe end of the ski boot will begin to move laterally, thus causing the rotation of jaw 4 against the resistance of resilient means 22, 24. Due to the aforesaid high frictional forces the bearing plate 13 tends to follow the boot movement and plate 12 begins to move laterally on its slideway 10. During this movement, the roller 15 carried by plate 12 cooperates with cam 16 and pushes the slide 18 towards the front end of the ski. Therefore, the extension of slide 19 begins to compress the spring means 22, 24.

From the foregoing it appears clearly that the resilient means 22, 24 are urged at the same time and in the same direction by the flat face 26 and by the extension 19.

Therefore, with its movement said plate 12 facilitates the opening of the toe fitting and assists same in overcoming the resistance of said resilient means 22, 24.

Preferably, the contour of cam 16 is so designed that the boot movement is attended by the same movement of piston 24, whether as a consequence of the rotation of jaw 4 or as a consequence of the lateral movement of plate 12, assuming that no slip occurs between the sole and the bearing plate 13.

Figure 7:
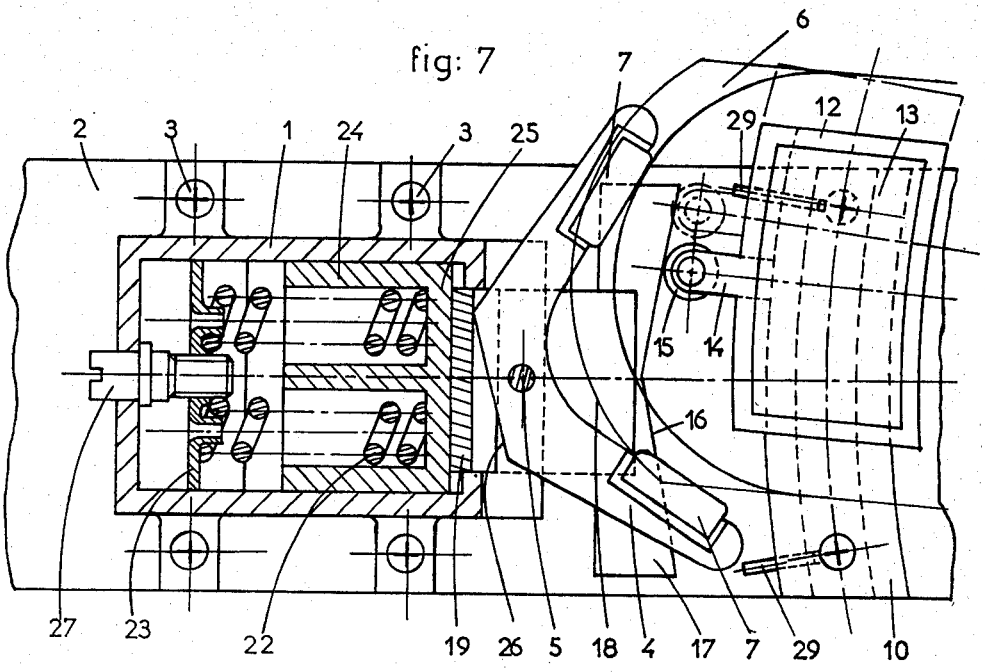
FIG. 7 is another view similar to FIG. 2 showing the mode of operation of the toe fitting when a relatively high coefficient of friction interferes with a free relative movement between the boot sole and its support.

The endmost position of plate 12, shown in chain-dotted lines in FIG. 7, is preferably coincident with the release position of boot 6 with respect to jaw 4.

The mode of operation of the toe fitting has been described hereinabove in connection with a boot release movement occuring towards the right in the case of a skier looking at the toe end of his ski boot. Of course, the same mode of operation would be observed in case of lefthand release movement of the toe end of the ski boot, due to the symmetrical arrangement of the device.

FIGS. 8 to 11 of the drawings illustrate another form of embodiment of a toe fitting according to this invention.

This modified embodiment comprises a body 30 mounted for rotation about a vertical pivot pin 31 of tubular configuration, rigid with a base member 32 fastened to the ski 2. This tubular pivot pin 31 has formed thereon by milling a flat cam-forming forwardly-directed face 33. A piston 34 is slidably mounted in a cylindrical bore 35 of said body 30 and bears with a flat face 36 against the cam 33. This piston 34 is urged by a coil compression spring 37 reacting against an adjustment plug 38 screwed in said body 30.

A small lever 39 is housed in the cavity of the tubular pivot pin 31 and has its upper end fulcrumed in turn therein about a transverse pivot pin 40 rigid with pin 31. This lever 39 comprises an intermediate projection 41 engaging a shallow cavity formed centrally of piston 34.

The toe end of boot 42 is held against antifriction linings or elements 43 carried by the side arms 44, the latter being an integral part of the body 30 and constituting the toe fitting jaw. The boot 42 bears through its normalised smooth portion on a supporting device similar to the device described in the preceding form of embodiment and consisting of a T-sectioned slideway 46 of arcuate configuration on which a plate 47 provided with a top lining 48 for direct engagement with the boot sole is adapted to slide. The plate 47 has a central front extension 49 provided with a free-rotating roller 50. Mounted in base plate 32 are a pair of horizontal levers 51*a*, 51*b* pivoted about vertical pins 52*a*, 52*b* respectively and each provided with a cam face 53*a*, 53*b*, respectively. These cam faces, directed towards the boot, i.e. to the rear, are both in direct contact with said roller 50.

On their opposite sides facing the front end of the ski the levers 51*a*, 51*b* are each provided with an integral lug-like projection 54*a*, 54*b*, respectively, engaging a slide 55 mounted in base member 32 for axial sliding movement therein. The front end of slide 55 engages the lower portion of lever 39 and its rear end constitutes a vertical extension 56 engageable by the toe end of the boot sole.

In this modified form of embodiment, when an excessive torsional stress is exerted on the skier's leg the toe end of boot 42 tends to escape by moving laterally and causes a corresponding movement of one of said arms 44, thus rotating the body 30 about its pivot pin 31. This release movement is obtained against the resistance of the resilient devise comprising spring 37, piston 34 and cam 33.

When the bottom surface of the boot sole is dirty or in bad shape, the sole will also carry along the plate 48 and its roller 50. Now the latter, by bearing against one of said cam faces 53*a* or 53*b*, accordingly as the movement is directed to the left or to the right, will cause one of said levers 51*a*, 51*b* to pivot about its pin 52*a* or 52*b*, respectively.

As shown in FIG. 11, lever 51*a* has been moved laterally so as to push the slide 55 through its projection 54*a* into base member 32. Consequently, lever 39 is pivoted and tends to push piston 34 through its projection 41. This action will thus facilitate the boot release since said lever 39 assists in the action necessary for compressing the resilient means 37, 34 and 33.

FIG. 10 shows the function devolved to the vertical extension 56 of slide 55. In case of pronounced boot inclination (forward fall) the front end of the sole engages this extension 56 and moves the latter and therefore slide 55 forwards, so that the lever 39 is urged as in the preceding case against the piston 34 to compress its spring 37.

In this second form of embodiment, consequently, the resistance to the release action of the toe fitting is reduced not only in case a high frictional coefficient develops between the boot sole and its supporting device but also when the boot is inclined under forward fall conditions.

It will be seen that the position of projections 54*a*, 54*b* of levers 51*a*, 51*b*, and the position of projection 41 of lever 39, are such that a useful scaling down of the effort transmitted from roller 50 to piston 34 is obtained.

FIGS. 12 to 15 of the drawings illustrate a third and last form of embodiment of the toe fitting of this invention.

In this modified version a body 61 is fastened to the top surface of ski 2 and a pivoting jaw 64 cooperates with the toe end of the boot sole 62 in order to retain the boot on the ski. Formed in the front face of jaw 64 are a pair of vertical grooves 71 resiliently urged against bearing ribs 63 formed integrally with the body 61 and which, in a manner known per se, constitute the "knives" for causing the lateral tilting movement of jaw 64. The resilient force controlling the jaw 64 comprises a set of coil compression springs 66, 67 mounted in series in said body 61. These springs react against a shoulder 68 formed at the rear end of the bore of body 61 and against a nut-like adjustment plug 69 screwed on a corresponding threaded front portion of a tie-rod 65 having its rear end pivotally connected to said jaw 64 by means of a vertical pivot pin 70.

Guided in the base of the fixed body 61 is a slide 72 adapted to move in the axial direction. This slide 72 has a front vertical extension 73 interposed between the pair of tandem springs 66 and 67.

The ski boot 62 bears on a supporting device comprising a plate 77 to which a bearing plate 78 is suitably secured, said plate 77 being guided in an arcuate slideway 74 so that it can move across the ski.

Under the front portion of plate 77 a concave cam 75 in the form of a wide obtuse angle V is provided, the vertex thereof being normally directed towards the front end of the ski; this cam 75 is engaged by a stud 76 secured to the rear end of slide 72 (FIG. 15).

In order to warrant an efficient contact between said stud 76 and cam 75 irrespective of the degree of prestress imparted to springs 66, 67 by the adjustment plug 69, the stud 76 is adjustably mounted on slide 72. However, for the sake of simplification this adjustment device is not shown in the drawings.

FIG. 14 illustrates the mode of operation of this toe fitting under normal skiing conditions wherein the frictional contact between the boot sole and plate 78 is relatively moderate. The jaw 64 is caused to tilt about one of the knives 63, thus causing the tie-rod 65 to move slightly backwards. This movement is attended by an increment in the compression of the tandem springs 66, 67 operating like a single spring.

FIG. 13 shows the operation of the toe fitting when the boot sole is soiled or in bad shape so that it carries along the plates 78 and 77 during its lateral movement. Cam 75 formed on plate 77 actuates the follower 76, thus causing the slide 72 and its vertical extension 73 to recede. Now the inclination of cam 75 is such that the movement of slide 72 exceeds that of tie-rod 65 irrespective of the boot release movement. As a result, spring 67 is strongly compressed while spring 66 is allowed to expand. The force with which the ski boot is retained is thus exerted only by the expanded spring 66, therefore with a force lower than the initially preset value.

It will readily occur to those conversant with the art that various modifications may be brought to the toe fitting of the present invention without departing from the basic principle thereof. Thus, the boot supporting device may consist of a series of rollers engaged by the boot sole and adapted when rotated to reduce the antagonistic force of the resilient means. Furthermore, this invention is applicable to toe fittings of the type comprising a jaw made of two independent arms.

What I claim as new is:

1. A toe fitting of a safety ski binding comprising:

a body for fixed securement to an elongated ski;

a ski boot retaining jaw supported by said body for pivotal movement about a pin perpendicular to the top surface of the ski and against movement transverse to the elongation of the ski;

resilient means in said body for exerting on said jaw a presettable force against pivotal movement of said jaw;

supporting means for a toe end portion of the ski boot and including a member movable with respect to both the ski and said jaw in response to transverse movement of the boot; and means connecting said member and said resilient means to cause a decrease in the force exerted on said jaw by the resilient means as said member is moved in response to transverse movement of the boot.

2. A toe fitting in accordance with claim 1, wherein said connecting means comprises a slide disposed for guided movement along the ski elongation and engaging said resilient means and said member to actuate said resilient means when said slide is moved in response to movement of said member disposed under the ski boot.

3. A toe fitting in accordance with claim 2, further comprising cam and roller means disposed on cooperating portions of said member and slide for transmitting movement of said member to said slide.

4. A toe fitting in accordance with claim 1, wherein said member comprises a plate disposed substantially parallel to the top surface of the ski for movement substantially transverse to the elongation of the ski.

5. A toe fitting in accordance with claim 4, said plate being disposed for movement substantially transverse to the elongation of the ski along an arc centered about an axis about which the ski boot is movable in the ski binding.

6. A toe fitting in accordance with claim 1, said jaw being fixedly supported by said body against any movement relative to the ski other than said pivotal movement about the pin.

7. A toe fitting of a safety ski binding in accordance with claim 2, wherein the movement between said movable member and said slide is transmitted therebetween by means of force scaling down levers mounted for rotation about axes perpendicular to the top surface of the ski and formed with ramps adapted to cooperate with said movable member such that the sliding movement of said movable member along one or the other of said ramps is attended by the pivotal movement of the corresponding lever and the consequent movement of said slide.

8. A toe fitting of a safety ski binding in accordance with claim 2, wherein said slide is provided with a bearing member engageable by the toe end of the ski boot sole.

* * * * *